United States Patent [19]

Rousar et al.

[11] 3,981,490

[45] Sept. 21, 1976

[54] APPARATUS FOR DECOMPOSING ALKALI METAL AMALGAMS

[75] Inventors: Ivo Rousar; Vaclav Cezner, both of Prague; Milan Franz, Usti nad Labem; Miroslav Matusek, Pardubice, all of Czechoslovakia

[73] Assignee: Vyzkumny Ustav Anorganicke Chemie, Usti nad Labem, Czechoslovakia

[22] Filed: May 5, 1975

[21] Appl. No.: 574,341

Related U.S. Application Data

[63] Continuation-in-part of Ser. No. 468,542, May 9, 1974, abandoned.

[30] Foreign Application Priority Data

May 11, 1973 Czechoslovakia ..... 3375-73

[52] U.S. Cl. ..... 266/169; 204/249

[51] Int. Cl.[2] ..... C25C 1/04

[58] Field of Search ..... 55/91; 75/81; 209/48; 204/249; 210/DIG. 21; 261/114 VT; 266/8, 37; 423/180; 266/169, 170

[56] References Cited

UNITED STATES PATENTS

| | | | |
|---|---|---|---|
| 1,276,129 | 8/1918 | Smith | 204/249 |
| 2,083,648 | 6/1937 | Gorke | 423/180 |
| 3,104,949 | 9/1963 | Glover | 423/180 |
| 3,122,594 | 2/1964 | Kielback | 55/91 X |
| 3,215,614 | 11/1965 | Gardiner | 423/180 X |
| 3,392,102 | 7/1968 | Koch | 204/249 |
| 3,502,434 | 3/1970 | MacMillan | 423/180 |
| 3,556,490 | 1/1971 | Bockman | 55/91 X |
| 3,595,614 | 7/1971 | Ford et al. | 75/81 X |

FOREIGN PATENTS OR APPLICATIONS

| | | | |
|---|---|---|---|
| 144,830 | 4/1962 | U.S.S.R. | 55/91 |

*Primary Examiner*—Roy Lake
*Assistant Examiner*—Paul A. Bell

[57] ABSTRACT

An apparatus for the decomposition of the amalgams of alkali metals including a reaction body consisting of horizontally spaced layers of foraminous metals wettable by amalgam, e.g. steel grids, with alternately inserted layers of material unwettable by amalgam, e.g. graphite or titanium carbide.

2 Claims, 3 Drawing Figures

APPARATUS FOR DECOMPOSING ALKALI METAL AMALGAMS

This application is a continuation-in-part of application Ser. No. 468,542, filed May 9, 1974, now abandoned.

This invention relates to an apparatus for the decomposition of the amalgams of alkali metals.

The most common type of denuders so far used for the decomposition of amalgams of alkali metals are "decomposition towers". As a rule, these are filled with pieces of graphite. In the upper part of the tower, an inlet for amalgam is usually provided, while water is introduced into the lower part. The amalgam reacts with water, forming a solution of the alkali-metal hydroxide and liberating hydrogen which is taken away from the upper part of the tower. The decomposition of the amalgam which is carried out with the graphite, is virtually a reaction going on in a short-circuited fuel-cell. On the amalgam, serving as an anode, ionization of the alkali metal takes place while on the graphite, the cathode, hydrogen is formed.

Different set-ups of the decomposing towers have been known so far, e. g. wires of amalgam wettable metal immersed in water and rinsed by amalgam flowing down the surface of these wires. With the set-ups just described, the amalgam is not in electrical contact with the material upon which hydrogen evolves. Widely used is an arrangement having vertically spaced metal sheets wettable by amalgam and unwettable graphite plates, the amalgam flowing down both the sheets and plates. It is true that with the apparatus arranged in the described way, the metal sheets wettable by amalgam are in physical and electrical contact with the graphite serving for the hydrogen evolution, due to its vertical spacing. However, the time of stay of the amalgam in the reaction zone is unduly short since the amalgam rushes down the wettable sheets with considerable velocity.

As another well-known means for the decomposition of the amalgams of the alkali metals, so-called decomposition troughs can be mentioned; these are fitted with graphite plates immersed in the amalgam. Because of their low efficiency, however, this apparatus is not used very much anywhere.

All of the above-mentioned drawbacks can be avoided by employing the apparatus for the decomposition of the amalgams of alkali metals in conformation with the present invention.

Its essence lies in the successive spacing of horizontal layers of multi-perforated or foraminous metal materials wettable by amalgam, e.g. steel grids, alternately with the layers of unwettable carbon material as e.g. graphite or titanium carbide.

The reaction body of the apparatus, according to the present invention, comprises horizontally spaced first and second layers of amalgam, wettable and unwettable materials, respectively. The metal layer wettable by amalgam is built of intersticed sheets, gauzes or grids made of steel, nickel or an iron-nickel alloy.

Above the metal layer wettable by amalgam, there is a layer of carbon material, unwettable, by amalgam, such as graphite, titanium carbide, and sintered mixtures of titanium carbide and nickel.

Layers of materials wettable and unwettable by amalgam alternate regularly and are situated in distinct sections or trays spaced above one another. Trays, sections and even the packing are not distributed uniformly all over the cross-section of the apparatus, but there are interstices left for the hydrogen off-take. This free space, in the form of the vertical outlet passages, enables the quicker removing of the bubbles from the reaction space, and smaller bubble content in the electrolyte, and in this way a reduction of the specific resistance of the electrolyte-bubble mixture. The size of the interstice between the walls of the reaction body and the tower is constant and fixed by means of suitable distance pieces.

In this respect, the apparatus contributes to the prolonged stay of the amalgam in the region where there are the most favorable conditions for carrying out the reaction, i.e. in the places of contact between the amalgam wettable and unwettable materials. The amalgam flows down all the layer of the active material substantially slower than in an analogous device with vertically spaced amalgam wettable and unwettable layers. With such arrangements, the amalgam passing through the device is given a longer time for completing its decomposition.

In such a way, the height of the apparatus, as well as the power required for feeding the amalgam into the upper part of the tower, may be reduced to about 50% in relation to the arrangement with vertically spaced structure of plates.

The invention will now be described with reference to the accompanying drawing showing an expedient embodiment of the invention.

Figure 1:
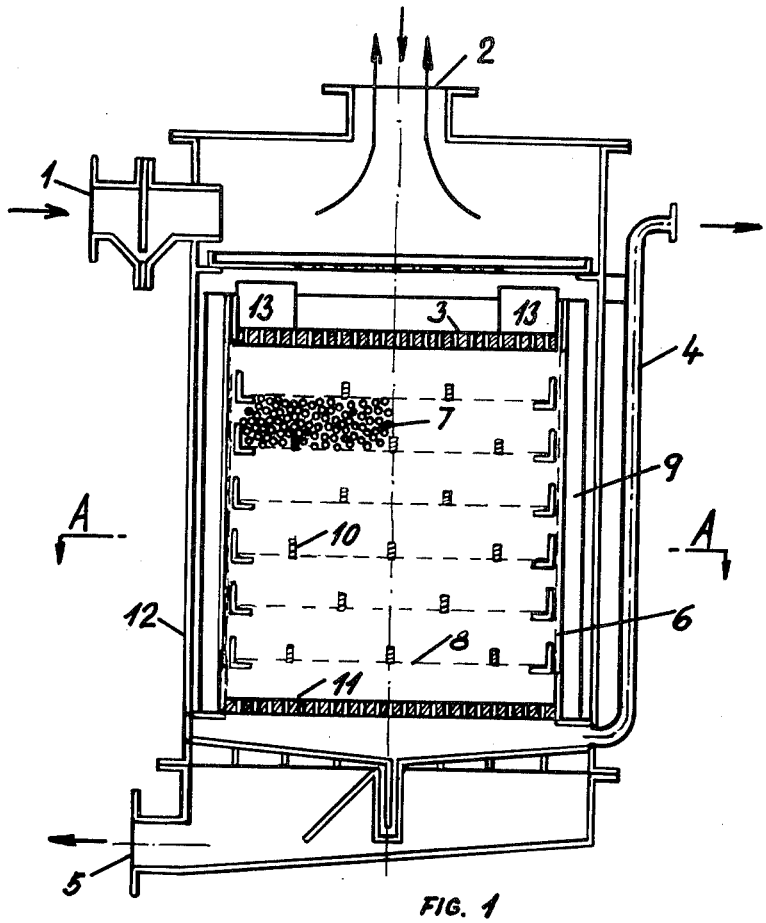
FIG. 1 is a transverse sectional view of the apparatus for decomposing of amalgam of alkali metals embodying the present invention.
Figure 2:
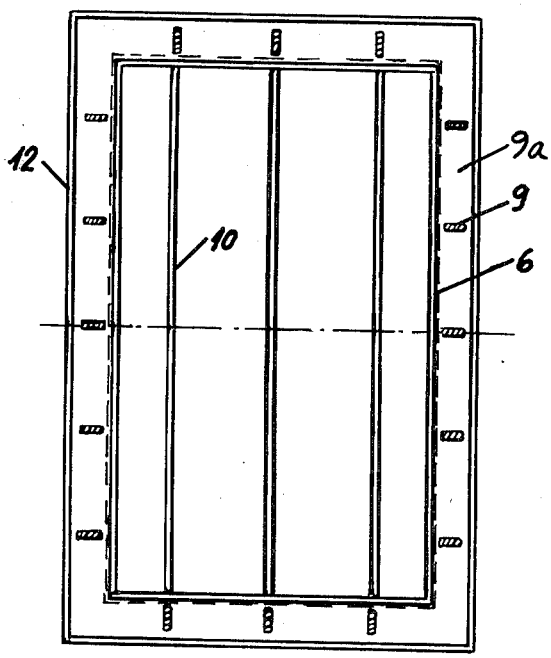
FIG. 2 is a view in cross-section of the same apparatus, the section being taken along the line A—A of FIG. 1.
Figure 3:
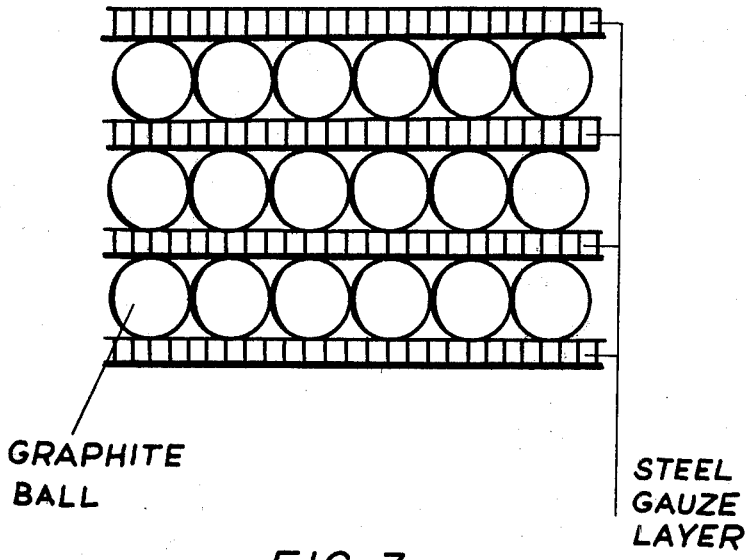
FIG. 3 is a fragmentary view in side elevation on an enlarged scale of a preferred embodiment in accordance with the invention.

The following numerals designate the accompanying parts of the embodiment illustrated in the drawings: 1 designates the inlet for amalgam; 2 the inlet for liquid water and the outlet for hydrogen and water vapors; 3 the distributor; 4 an outlet for alkali hydroxide; 5 an outlet for mercury; 6 a perforated wall of the reaction body; 7 a packing of graphite balls; 8 a perforated steel sheet; 9 a frame rib for fixing the reaction body in the tower; 10 a frame rib; 11 the bottom of the reaction body; 12 the tower wall; **9*a* an interstice between the walls 6 and 12; and 13** the ballast.

The following examples illustrate the use of the proposed arrangement of the apparatus:

EXAMPLE 1

A sodium amalgam containing 0.2 percent by weight of sodium is fed with water into the top part of an apparatus as shown in the drawing. NaOH is formed during the contact of sodium amalgam with water in the presence of graphite. The aqueous solution leaving the apparatus contains 40 percent by weight of sodium hydroxide. The temperature of operation inside the apparatus is maintained at 80°C. The specific removal of Hg from the amalgam is about 0.0125 moles of mercury per $cm^2$ of the cross-section of the packing volume per second. The reaction body consists of several layers of horizontally spaced steel gauzes having a mesh-size of 4 × 4 mm. Each individual layer of steel gauze support one single layer of graphite balls having a particle diameter of 1 cm. The packing is divided into six equal sections. The total height of the packing is 55 cm. The amalgam withdrawn from the tower contains about 0.01 percent by weight of sodium.

EXAMPLE 2

An analogous apparatus fitted with vertically spaced gauzes has a minimum height of about 95 cm for reducing the sodium content in the amalgam from the original value of 0.2 percent by weight to the final value of 0.001 percent by weight. The specific removal of mercury amounts to 0.0125 moles Hg per $cm^2$ per second; the temperature of operation is 80°C and the concentration of the withdrawn solution is maintained at 40 percent by weight.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. In an apparatus for decomposing amalgams of alkali metals, said apparatus having a tower with vertical wall means and a reaction body with perforated vertical means, and means for passing the amalgam and water through the tower and in contact with the reaction body therein, the improvement which comprises means providing an interstice for escape of hydrogen gas between the perforated vertical wall means of the reaction body and vertical wall means of the tower, and wherein the reaction body is of substantially uniform horizontal cross-section, said perforated vertical wall means are made of a metal chosen from the group consisting of steel, nickel and an iron-nickel alloy, and horizontally spaced perforated sheets in excess of two made of a metal chosen from the group consisting of steel, nickel and an iron-nickel alloy, said horizontal sheets being supported by said perforated vertical wall means and packings of particulate bodies between these perforated sheets, said particulate bodies being made of material chosen from the group consisting of graphite and titanium carbide and having the form of pellets, balls, chips and the like, whose diameter is 3–20 mm.

2. An apparatus according to claim 1, wherein the perforated walls and perforated sheets of steel, nickel or an iron-nickel alloy are gauzes or grids.

* * * * *